US007121708B2

(12) United States Patent
Tsai

(10) Patent No.: US 7,121,708 B2
(45) Date of Patent: Oct. 17, 2006

(54) ILLUMINATED LOGO UNIT WITH LIGHT GUIDE PLATE

(75) Inventor: Kun-Jung Tsai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 101 days.

(21) Appl. No.: 10/889,887

(22) Filed: Jul. 12, 2004

(65) Prior Publication Data

US 2005/0007751 A1 Jan. 13, 2005

(30) Foreign Application Priority Data

Jul. 11, 2003 (TW) ..... 92119082 A

(51) Int. Cl.
*F21V 7/04* (2006.01)

(52) U.S. Cl. ..... 362/605; 362/27; 362/616

(58) Field of Classification Search ..... 362/605, 362/610, 613, 612, 616, 621, 624, 623, 627, 362/609, 615, 625; 116/DIG. 5, DIG. 26; 40/541, 564

See application file for complete search history.

(56) References Cited

U.S. PATENT DOCUMENTS 2,646,637 A * 7/1953 Nierenberg et al. ..... 40/364
4,777,480 A * 10/1988 Okamoto et al. ..... 340/688
5,070,431 A * 12/1991 Kitazawa et al. ..... 362/601
5,806,955 A * 9/1998 Parkyn et al. ..... 362/612
6,174,075 B1 1/2001 Fuwausa

* cited by examiner

*Primary Examiner*—Renee Luebke
*Assistant Examiner*—Gunyoung T. Lee
(74) *Attorney, Agent, or Firm*—Wei Te Chung

(57) ABSTRACT

An illuminated logo unit (300) includes an image panel (301), and an underlying illuminating device (310) transmitting light beams to the image panel. The illuminating device includes an inner discoid light guide plate (312) fitted into an outer annular light guide plate (311), and four light sources (369, 359) separately emitting light beams toward respective emitting surfaces (360, 350) of the light guide plates. A reflective film (362) coated on a circumferential wall (361) of the inner light guide plate prevents light beams in each light guide plate from interfering with light beams of the other light guide plate. A reflective film (352) coated on a circumferential wall (351) of the outer light guide plate prevents light beams from leaking thereout. By the use of the light guide plates, the illuminated logo unit attains uniform illumination in each of two illumination areas thereof.

9 Claims, 6 Drawing Sheets

ILLUMINATED LOGO UNIT WITH LIGHT GUIDE PLATE

BACKGROUND OF THE INVENTION

1. Field of the Invention

The present invention relates to an illuminated logo unit, and particularly to an illuminated logo unit having uniform illumination in each of discrete illumination areas thereof.

2. Prior Art

A conventional logo unit, such as a registration mark on a billboard or an insignia on a vehicle, cannot illuminate itself. If the image of the logo unit is to be clearly seen at night, it must be illuminated by an external source. However, external illumination has various inherent limitations, including the angle of illumination, the brightness of the source, and the reflective ratio of the logo unit. These limitations frequently result in the logo unit being unevenly illuminated. Furthermore, the brightness and overall display of the logo unit may be unsatisfactory.

Generally, to solve the above-described problems, an active light source is arranged at the back of the logo unit. A logo unit having an active light source arranged at the back thereof is known as an illuminated logo unit.

A conventional illuminated logo unit 100 as disclosed in U.S. Pat. No. 6,174,075 is represented in FIG. 7. The unit 100 has a top surface 110, and a circumferential lip 132 which may be used to secure the unit 100 to a garment or another article such as a hat. The top surface 110 includes one or more graphic elements, which form a predetermined design. The top surface 110 may be separated from the lip 132 by a cylindrical sidewall 131. The unit 100 is formed with a central cavity 135, which spans to a bottom surface (not labeled) of the unit 100. The cavity 135 is structured to receive a light source system 133, which transmits light beams to pass through the top surface 110. The light source system 133 has a point light source 137, and batteries 138 providing power to the point light source 137.

Because the point light source 137 is arranged corresponding to a center of the top surface 110, the distribution of light energy over the whole top surface 110 from the point light source 137 is uneven. For example, a central circular area on the top surface 110 receives much more light energy from the point light source 137 than other portions of the top surface 110. Accordingly, a brightness of the top surface 110 is not uniform. The result is that the entire top surface 110 cannot be clearly seen at night.

A new illuminated logo unit that overcomes the above-mentioned disadvantages is desired.

SUMMARY OF THE INVENTION

An object of the present invention is to provide an illuminated logo unit with uniform illumination.

Another object of the present invention is to provide an illuminated logo unit with uniform illumination in each of discrete illumination areas thereof.

To achieve the above-mentioned objects, an illuminated logo unit of the present invention includes an image panel, and an underlying illuminating device transmitting light beams to the image panel. The illuminating device comprises at least two juxtaposed light guide plates and at least two corresponding light sources. The light sources separately emit light beams to the light guide plates respectively. Reflective films coated on peripheral walls of the light guide plates prevent light beams in each light guide plate from interfering with light beams of another adjacent light guide plate, and prevent light beams from leaking out through the peripheral wall of the outmost light guide plate. Reflective films coated on bottom surfaces of the light guide plates reflect light beams from the respective light sources in directions toward respective emitting surfaces of the light guide plates. All the reflective films concentrate light beams from the respective light sources toward the respective emitting surfaces. By the use of the light guide plates, the illuminated logo unit attains uniform illumination in each of illumination areas thereof.

Other objects, advantages and novel features of the invention will become more apparent from the following detailed description when taken in conjunction with the accompanying drawings; in which:

DETAILED DESCRIPTION OF THE PREFERRED EMBODIMENTS

Hereinafter, exemplary embodiments of the present invention will be explained in detail with reference to the accompanying drawings.

Figure 1:
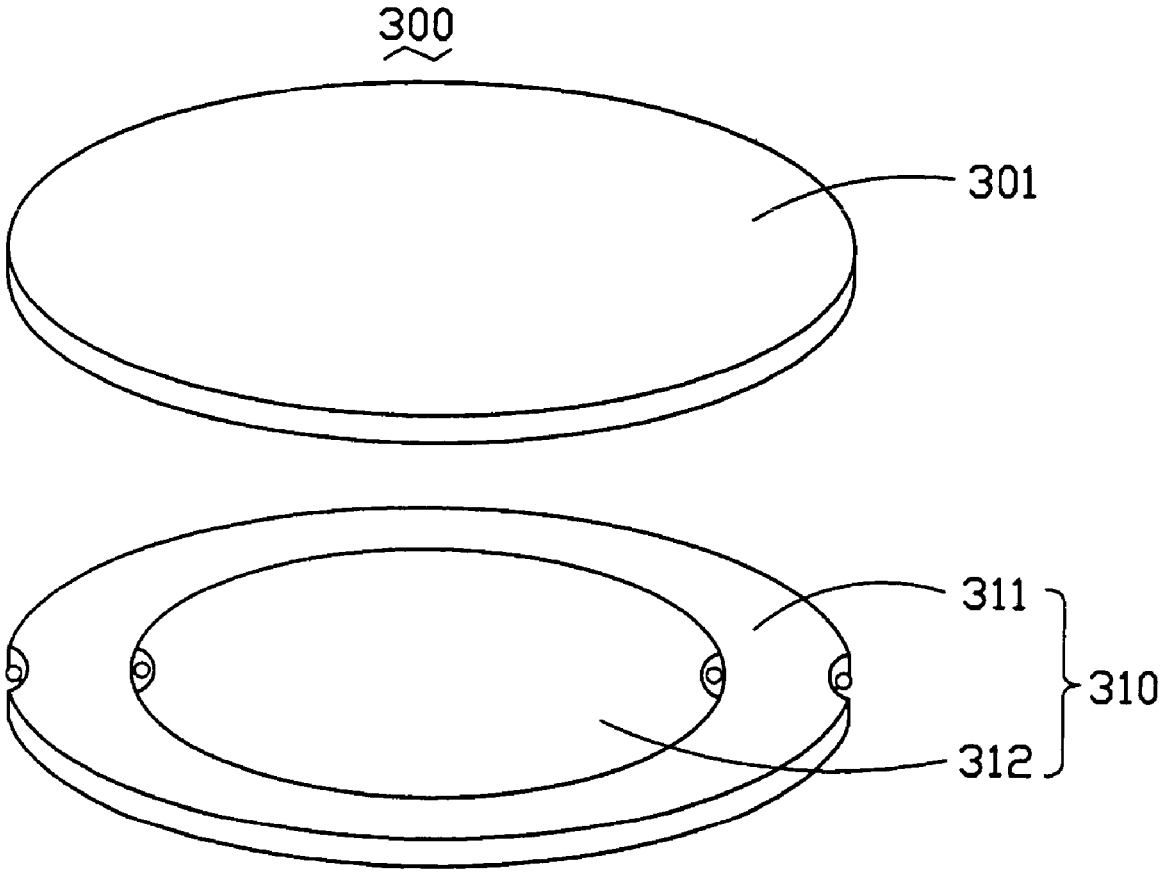
FIG. 1 is an exploded, perspective view of an illuminated logo unit in accordance with a first embodiment of the present invention.

FIG. 1 is an exploded, perspective view of an illuminated logo unit 300 according to the first embodiment of the present invention. The illuminated logo unit 300 comprises an illuminating device 310, and an image panel 301 disposed on the illuminating device 310. The image panel 301 is preferably flexible or pliable, being made of a plastic material such as polyvinyl chloride (PVC). In this case, the image panel 301 is attached on the illuminating device 310. Alternatively, the image panel 301 can be made of a hard material, in which case it is fastened on the illuminating device 310 by a frame or a clip (not shown).

Figure 2:
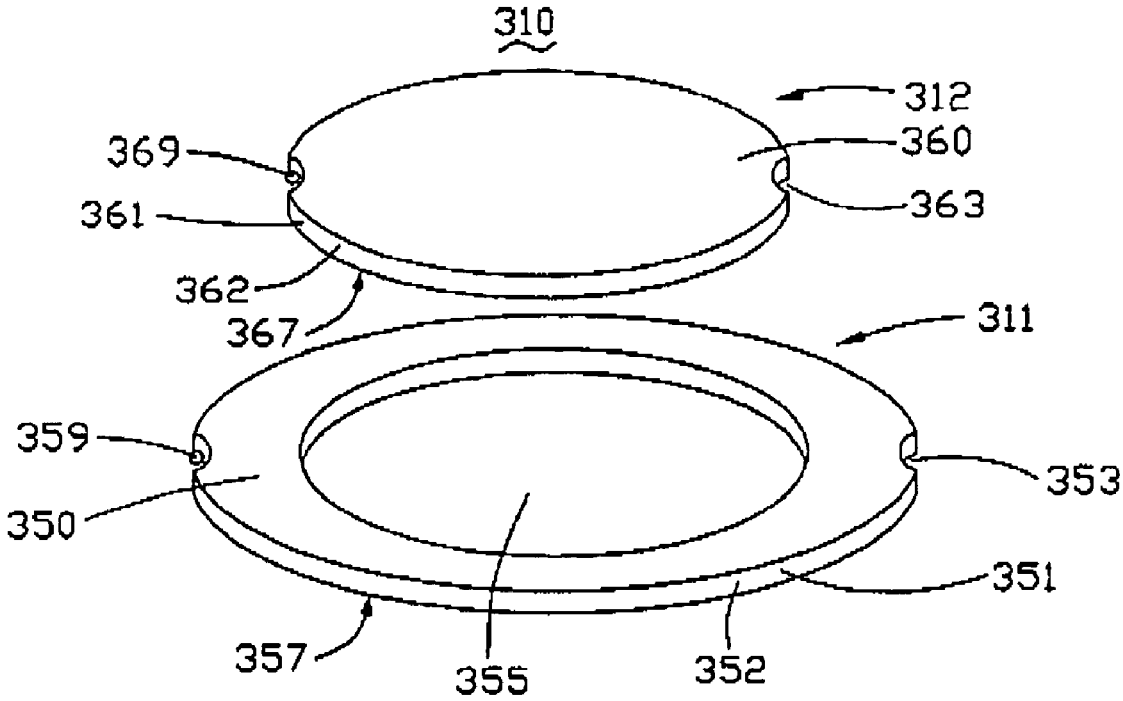
FIG. 2 is an exploded perspective view of an illuminating device of the illuminated logo unit of FIG. 1, but only showing two of four light sources thereof.
Figure 3:
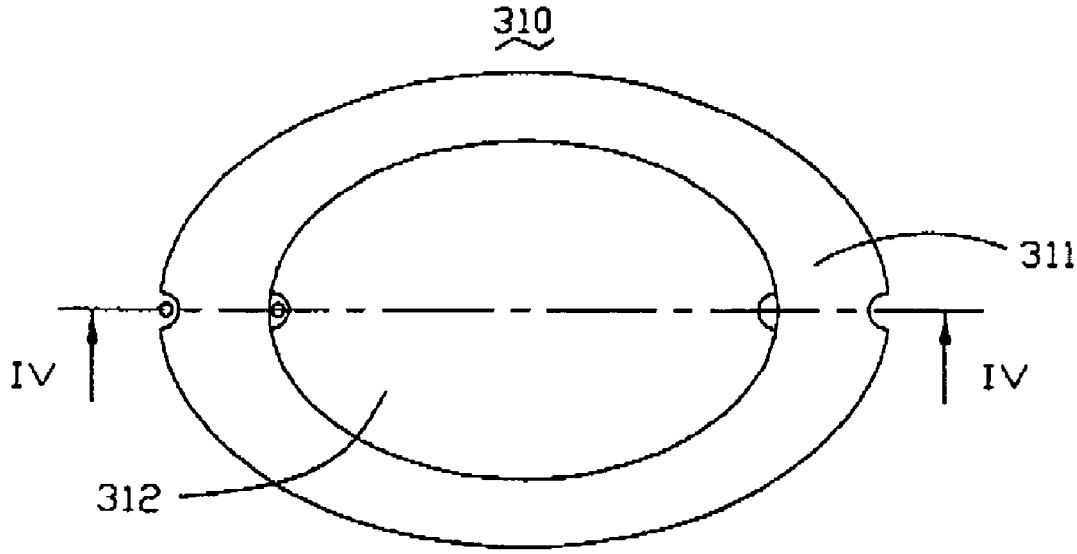
FIG. 3 is a top elevation of the illuminating device of FIG. 2 fully assembled.

Referring to FIG. 2 and FIG. 3, the illuminating device 300 comprises an annular first light guide plate 311, a second light guide plate 312 matching with the first light guide plate 311, and a plurality of light sources 359, 369.

Figure 4:
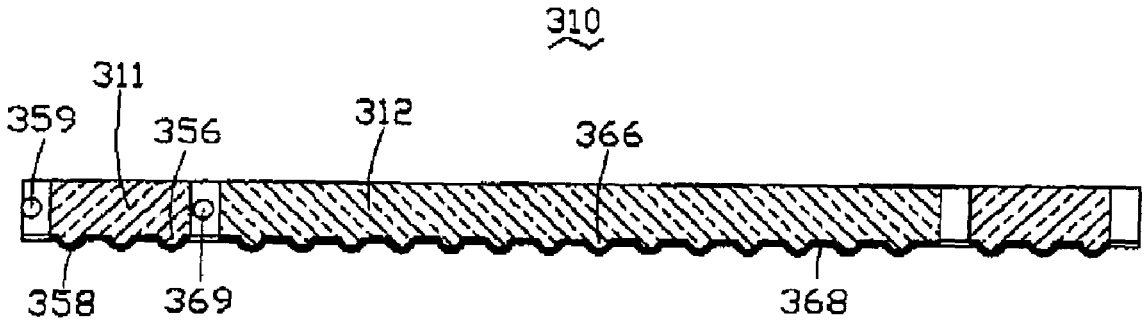
FIG. 4 is a schematic, cross-sectional view of the illuminating device of FIG. 3, taken along line IV—IV thereof.

The first light guide plate 311 comprises a first emitting surface 350 for emitting light beams, a first circumferential sidewall 351 adjoining the first emitting surface 350, a first bottom surface 357 opposite to the first emitting surface 350, and a central hole 355. The first circumferential sidewall 351 defines two opposite grooves 353, and has a reflective film 352 attached thereon except at the grooves 353. The reflective film 352 prevents light beams from leaking out through the first circumferential sidewall 351. The grooves 353 respectively accommodate two light sources 359. The light sources 359 may be point light sources. Light beams emitted from the light sources 359 enter the first light guide plate 311 through respective incident surfaces (not labeled) at the grooves 353. As shown in FIG. 4, the first bottom surface 357 has a plurality of dots 356 for diffusing light beams, and a reflective film 358 for reflecting light beams to the first emitting surface 350.

The second light guide plate 312 is fitted into the hole 355 of the first light guide plate 311, and comprises a second emitting surface 360, a second circumferential sidewall 361, and a second bottom surface 367 opposite to the second emitting surface 360. The second circumferential sidewall 361 defines two opposite grooves 363, and has a reflective film 362 attached thereon except at the grooves 363. The reflective film 362 prevents light beams from interfering with light beams of the first light guide plate 311. The grooves 363 respectively accommodate two light sources 369. The light sources 369 may be point light sources. Light beams emitted from the light sources 369 enter the second light guide plate 311 through respective incident surface (not labeled) at the grooves 363. As shown in FIG. 4, the second bottom surface 367 has a plurality of dots 366 for diffusing light beams, and a reflective film 368 for reflecting light beams to the second emitting surface 350.

In operation, the second light guide plate 312 is accommodated in the hole 355 of the first light guide plate 311. The light sources 359, 369 separately emit light beams to the first light guide plate 311 and the second light guide plate 312 respectively. By the use of the reflective films 352, 362 and the reflective film 358 on the first bottom surface 357, light beams from the light sources 359 are concentrated at the first emitting surface 350. The reflective film 352 prevents the light beams from leaking out from the first circumferential sidewall 351. The reflective film 362 prevents light beams from transmitting into the second light guide plate 312. The reflective film 358 on the first bottom surface 357 reflects light beams from the light sources 359 in directions toward the first emitting surface 350. Furthermore, the dots 356 on the first bottom surface 357 eliminate total internal reflection of light beams by diffusing the light beams thereat, thereby attaining uniform illumination over the whole first emitting surface 350.

In the second light guide plate 312, light beams from the light sources 369 are concentrated to the second emitting surface 360 by the use of the reflective film 362 on the second circumferential sidewall 361 and the reflective film 368 on the second bottom surface 367. The reflective film 362 reflects light beams impinging on the second circumferential sidewall 361 back into the second light guide plate 312. This prevents the light beams from interfering with light beams of the first light guide plate 311. The reflective film 368 on the second bottom surface 367 reflects light beams from the light sources 369 in directions toward the second emitting surface 360. Furthermore, the dots 366 on the second bottom surface 367 eliminate total inner reflection of light beams by diffusing the light beams thereat, thereby attaining uniform illumination over the whole second emitting surface 360.

In summary, the illuminating device 310 defines two illumination areas according to the first and the second light guide plates 311, 312. By adjusting the colors and the illuminating intensities of the light sources 359, 369, the illuminating device 310 can have two different illumination areas with different colors and different illumination intensities.

Figure 5:
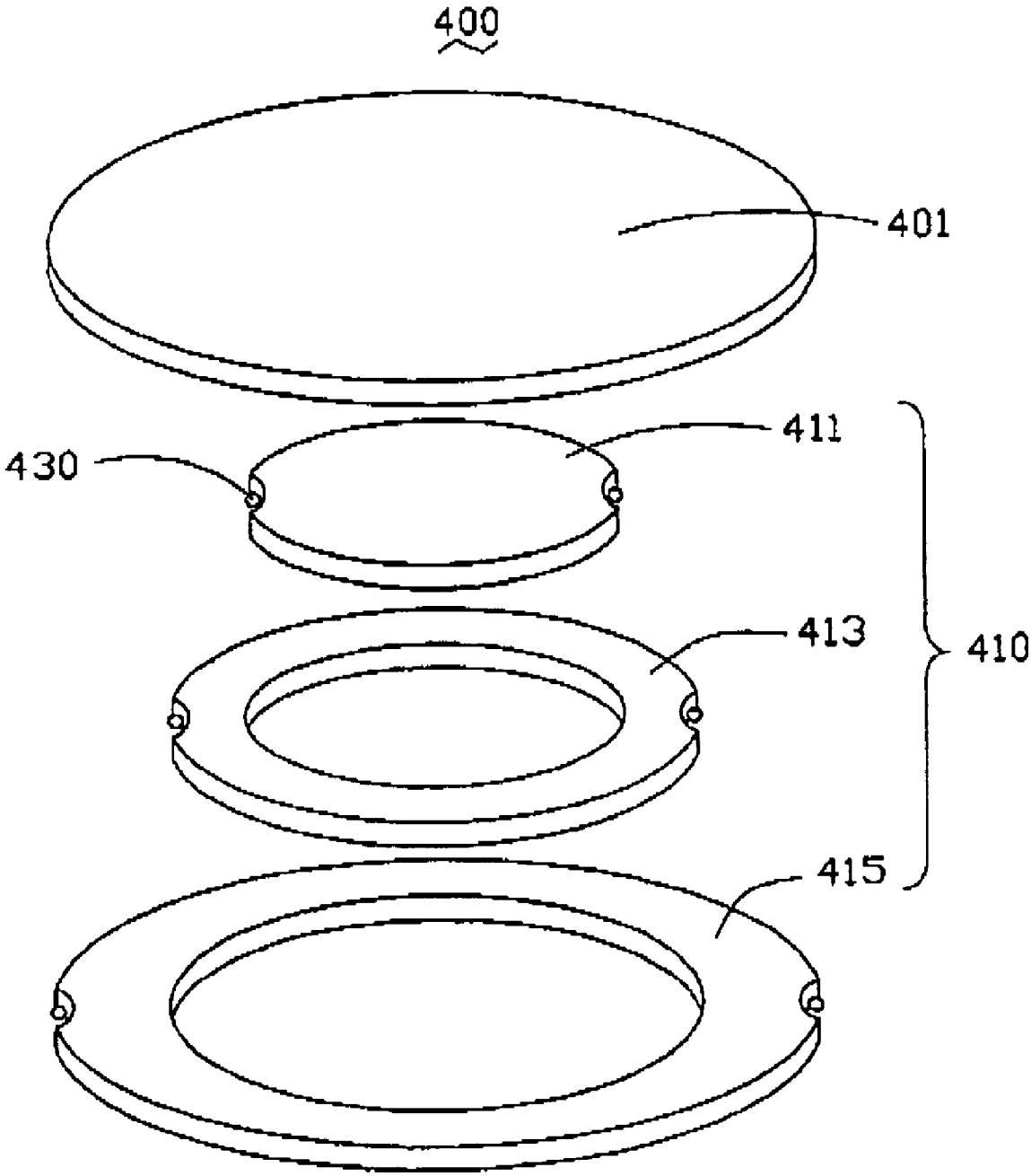
FIG. 5 is an exploded, perspective view of an illuminated logo unit in accordance with a second embodiment of the present invention.

As shown in FIG. 5, an illuminated logo unit 400 in accordance with the second embodiment of the present invention has a structure similar to that of the illuminated logo unit 300 of the first embodiment. The illuminated logo unit 400 comprises an illuminating device 410 and an image panel 401. The illuminating device 410 has three light guide plates 411, 413, 415 matching with each other, and a plurality of light sources 430 emitting light beams to the three light guide plates 411, 413, 415 respectively. The light sources 430 may be point light sources. Each light guide plate 411, 413, 415 has a circumferential sidewall, with a reflection film coated on the circumferential sidewall. The light guide plates 411, 413, 415 are inlaid one to the other, thereby forming three illumination areas. By controlling the colors and illumination intensities of the light sources 430, the illuminated logo unit 400 can have three different colors and three different intensities in the three illumination areas.

Figure 6:
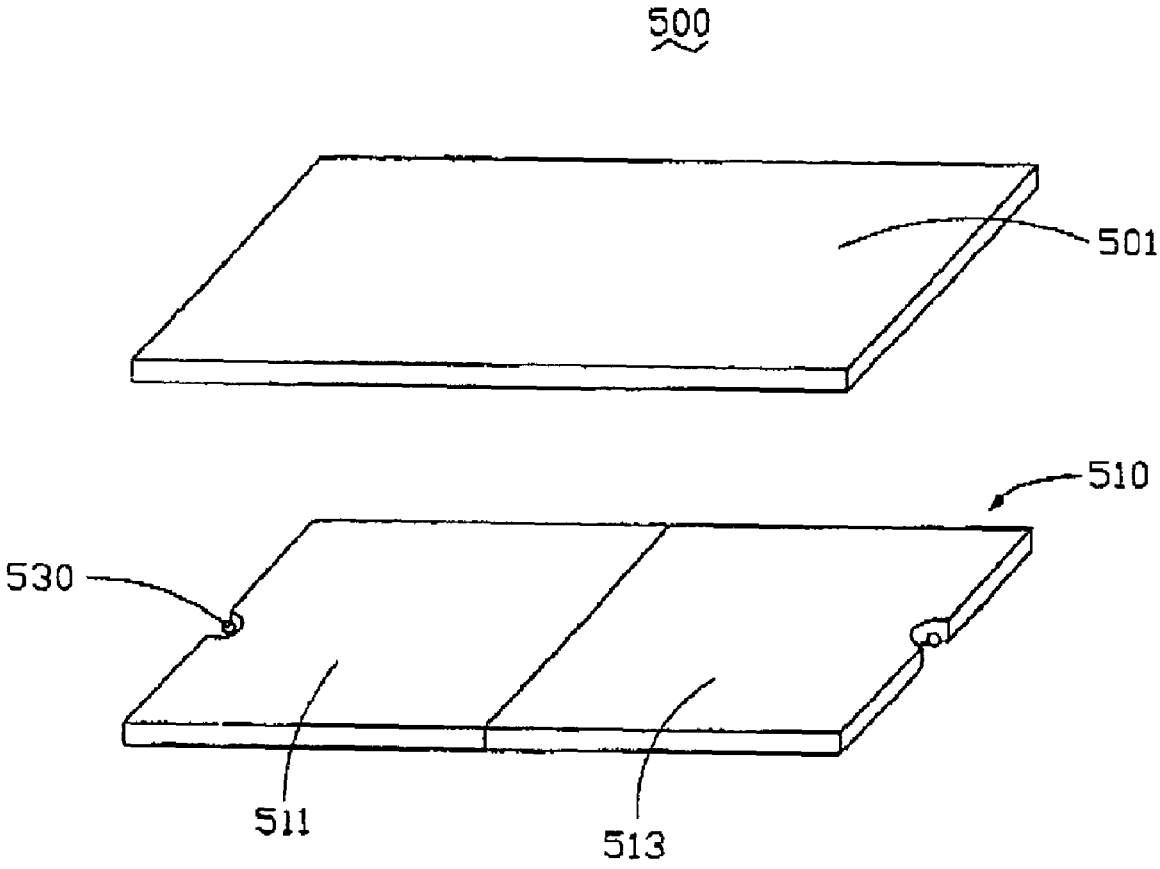
FIG. 6 is an exploded, isometric view of an illuminated logo unit in accordance with a third embodiment of the present invention.
Figure 7:
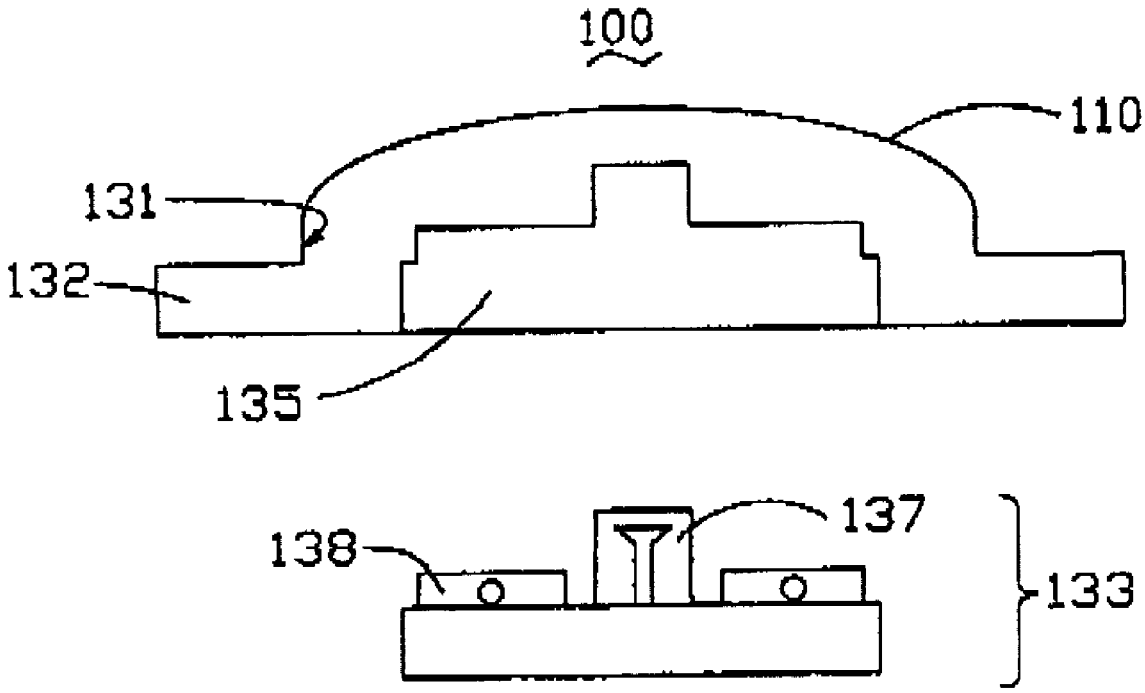
FIG. 7 (PRIOR ART)
FIG. 7 is an exploded, schematic cross-sectional view of a conventional prior art illuminated logo unit.

FIG. 6 is an exploded, isometric view of an illuminated logo unit 500 in accordance with the third embodiment of the present invention. The illuminated logo unit 500 is similar to the illuminated logo unit 300 of the first embodiment. The illuminated logo unit 500 has an image panel 501, and an illuminating device 510 transmitting light beams to the image panel 501. The illuminating device 510 includes two light guide plates 511, 513, and a plurality of light sources 530 cooperating with the light guide plates 511, 513, respectively. The light sources 530 may be point light sources. The light guide plate 511 is juxtaposed with the light guide plate 513 to form two juxtaposed illumination areas. A reflective film is provided between the light guide plates 511, 513, in order to prevent light beams in either light guide plate 511, 513 interfering with light beams of the other light guide plate 513, 511.

The shapes and numbers of the various light guide plates described can be varied according to need. Furthermore, and colors and illumination intensities of the various light sources described can be varied according to need. Thus a desired display that is clear can be obtained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An illuminated logo unit, comprising:

an image panel; and an illuminating device for illuminating the image panel, the illuminating device including: a first illuminating module including a first light source, and a first light guide plate having a through hole therein; and a second illuminating module including a second light guide plate and a second light source, the second light guide plate and the second light source being received in the through hole of the first light guide plate.

2. The illuminated logo unit of claim 1, wherein the second illuminating module is light insulated from the first illuminating module.

3. The illuminated logo unit of claim 1, wherein the first light source faces a first side of the first light guide plate, the second light source faces a second side of the second light guide plate.

4. The illuminated logo unit of claim 3, wherein the first light guide plate comprises a first groove in the first side thereof, the first light source is accommodated therein.

5. The illuminated logo unit of claim 3, wherein the second light guide plate comprises a second groove in the second side thereof, the second light source is accommodated therein.

6. The illuminated logo unit of claim 1, wherein at least one of the first and second light guide plates comprises a bottom surface with a plurality of dots formed thereon.

7. The illuminated logo unit of claim 1, wherein at least one of the first and second light guide plates comprises a bottom surface with a bottom reflecting film arranged thereon.

8. The illuminated logo unit of claim 1, wherein the first light guide plate is annular in shape.

9. The illuminated logo unit of claim 1, wherein each of the first and second light guide plates comprises a side reflective film arranged on sidewalls thereof.

* * * * *